United States Patent [19]

Conn

[11] 4,378,037

[45] Mar. 29, 1983

[54] THREE-WAY LOG SPLITTER ASSEMBLY

[76] Inventor: John L. Conn, P.O. Box 4501, Spartanburg, S.C. 29303

[21] Appl. No.: 224,177

[22] Filed: Jan. 12, 1981

[51] Int. Cl.[3] ..... B27L 7/00

[52] U.S. Cl. ..... 144/193 D; 144/193 R

[58] Field of Search ..... 125/23 R; 144/3 K, 193 R, 144/193 A, 193 C, 193 D

[56] References Cited

U.S. PATENT DOCUMENTS 3,982,572 9/1976 Kortendick ..... 144/193 D 4,102,373 7/1978 Winiasz ..... 144/3 K 4,192,364 3/1980 Findley ..... 144/193 A

*Primary Examiner*—W. D. Bray

[57] ABSTRACT

This invention relates to a device used for splitting logs or the like.

The purpose of the device is to provide a means for splitting a log into usable portions by positioning a log to be split between an upper and lower hexagon shaped wedge for manually advancing said upper wedge downwards towards the lower fixed wedge to split a log into three pieces.

3 Claims, 4 Drawing Figures

14A
15A
16
14C
14B
15C
15B
10A 10B
9A
8C
8A
8B
9C
9B
6
7

11A
17
18
11C
11B
22
20
22
22
20
20
17
17
12
21A
21C
21B
13A
13C
13B 3A
19
19
3C
3B
2
19
1
5A
5C
5B
4

THREE-WAY LOG SPLITTER ASSEMBLY

BACKGROUND OF THE INVENTION

This invention relates to the common wood splitting wedge that is used to split logs for firewood with a hammer.

Wedges and wood splitting devices have been known for years, but the construction of a three-way log splitter having the ability to split a log in three equal pieces is NEW and NOVEL.

The construction of a three-way log splitter having a bottom hexagon shaped wedge positioned centrally under a log and having another similar wedge positioned centrally above a log in order to utilize a hammer's force to split a log simultaneously from both ends is also NEW and NOVEL.

BRIEF SUMMARY OF THE INVENTION

It is therefore a primary object of this invention to provide a three-way wedge assembly whereby a log may be split from both ends at the same time into three equal pieces instead of two pieces thus saving work force and time. It is another object to provide a three-way wedge assembly whereby the work force that normally is wasted in the common one wedge method can be used to also do splitting work. It is another object to provide a hexagon shaped wedge assembly whereby there is no danger of the wedge jumping out of a log and causing injury.

BRIEF DESCRIPTION OF THE INVENTION

The accompanying drawings, which are incorporated in and constitute a part of this specification, illustrate one design of the invention, and therefore with a description serve to explain the principles of the invention.

DETAILED DESCRIPTION OF THE INVENTION

Figures 1, 2, 3, 4:
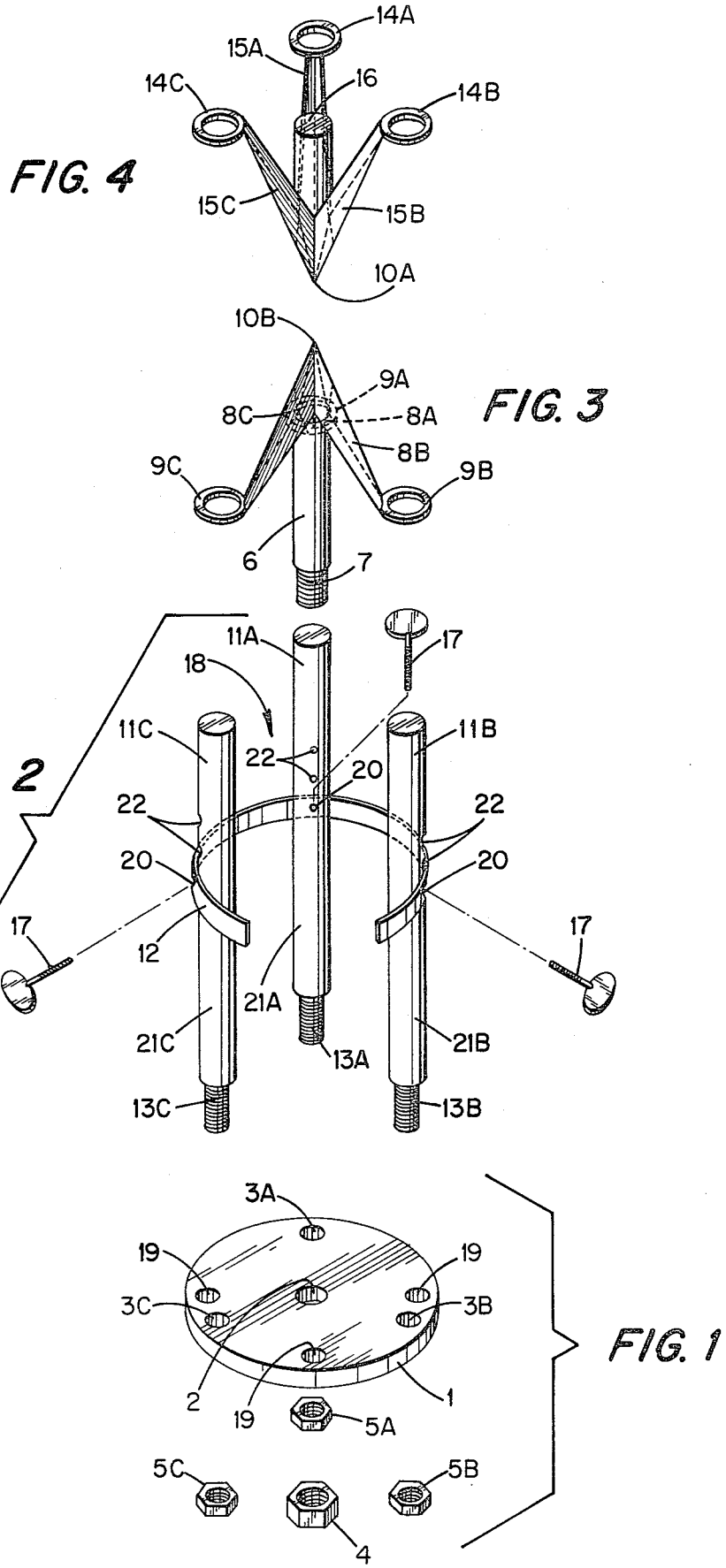
FIG. 1 is a view of the circular base plate that supports and houses the invention.
FIG. 2 is a view of the three support arms with the circular brace band.
FIG. 3 is a view of the bottom hexagon shaped cutting wedge with the bottom mounted extended shaft area with threaded end.
FIG. 4 is a view of the top hexagon shaped cutting wedge with the top mounted hammering area.

Referring now to the drawings and more particular to FIG. 1 which represents a circular shaped base plate (1) having a centrally located hole (2) so to connect the hexagon shaped cutting wedge of FIG. 3 at the wedge's threaded end area (7) with nut (4) and the base plate (1) having equally spaced holes (3A, 3B, 3C) to connect the circular shaped support arm's (11A, 11B, 11C) threaded ends (13A, 13B, 13C) with the nuts (5A, 5B, 5C) and said base plate (1) having anchoring holes (19) to secure the base plate (1) to a work area. The three perpendicular and circular shaped support arms (11A, 11B, 11C) are connected to the base plate (1) at the hole areas (3A, 3B, 3C) and extending in height sufficient to accommodate a height that is greater than the height of the bottom wedge (FIG. 3) and top wedge (FIG. 4) plus the height of the intended logs to be split (logs not shown). The support arms (11A, 11B, 11C) being circular in shape and equally spaced around the base plate (FIG. 1) and being centrally supported together by the circular shaped trace band (12) at the arm's multipe screw holes (22) and brace's holes (20) with the connecting screws (17) said brace band (12) will give stability to the support arms (11A, 11B, 11C) and will also serve as a stopping point for the top wedge (FIG. 4) from coming into contact with the bottom wedge (FIG. 3).

The base plate (FIG. 1) and the support arms (FIG. 2) does not come in contact with a log to be split, their circumferences being larger than the logs to allow splitting of the log. The log to be split will rest upon FIG. 3 with FIG. 4 being placed upon the top of the log.

FIG. 3 illustrates a solid hexagon shaped wedge with apex pointed area (10B) and with each axes forming three equally spaced extended triangularly shaped wedge arms (8A, 8B, 8C) and said arms having horizontal rings (9A, 9B, 9C) located on their end areas that are positioned over the support arms (11A, 11B, 11C) at areas (21A, 21B, 21C) to hold the hexagon wedge of FIG. 3 in proper position, and said hexagon wedge having an extended perpendicular support shaft (6) located on the wedge's (FIG. 3) opposite side wherein said support shaft (6) having an externally threaded end (7) so to connect the wedge assembly (FIG. 3) to the base plate (1) at hole (2) by connecting the nut (4) to the shaft (6) at the threaded area (7).

FIG. 4 illustrates a solid hexagon shaped wedge with apex pointed area (10A) and with each axis forming three equally spaced extended triangularly shaped wedge arms (15A, 15B, 15C) and having horizontal rings (14A, 14B, 14C) located on the arm's ends that are positioned over the support arms to split a log, said hexagon wedge having an extended perpendicular hammering head (16) that is located on the wedge's (FIG. 4) opposite side.

A log may be split as follows:

A log is placed inside (18) the support arms (11A, 11B, 11C) with the center of the log resting upon the apex area (10B) of the bottom wedge (FIG. 3) and the top wedge (FIG. 4) being placed over the log with the apex wedge area (10A) resting upon the center of the log and with the extended wedge arm rings (14A, 14B, 14C) being positioned over the support arms (11A, 11B, 11C) and then proceed to drive the top wedge (FIG. 4) by hammering on area (16).

Be it noted that the rings of the top wedge are in the same perpendicular plane as the support arms.

While various designs may be made in the construction of this invention, it is hoped that such changes will not alter the spirit and scope as is defined by the claims.

What is claimed:

1. A manually operated three-way log splitting device comprising: a flat circular shaped base plate having means to connect centrally thereon a first hexagon shaped cutting wedge; means wedge to anchor said flat, circular shaped base plate to a work area, said flat, circular shaped base plate having connecting means to connect with three support arms means at one respective end area thereof, said support arm means being disposed perpendicularly to and affixed equally spaced around said flat, circular shaped base plate, and having opposite open top ends and also having centrally located multiple adjusting holes therein; a circular shaped stabilizing brace band means detachably connectable to selected one of said adjusting holes; means for connecting said brace band to said support arm means; a second hexagon shaped cutting wedge means slidably disposed on said said support arm means in opposition to said first hexagon shaped wedge means.

2. The log splitting device as set forth in claim 1, wherein said first hexagon shaped wedge has an apex and pointed top area; each axis of said hexagon shaped wedge forming three equally spaced extended triangularly shaped wedge arms; each arm's length being equal to the radius length of the circumference of the affixed three support arm means; said triangularly shaped wedge arms having horizontally positioned rings located on their end areas, said horizontally positioned rings being larger in circumference than said support arm means coplanar with said; said hexagon shaped wedge having a centrally located extended perpendicular support shaft located on the hexagon shaped wedge's opposite side, said support shaft having means to connect to the connecting means of said flat, circular shaped base plate's central area.

3. The log splitting device as set forth in claim 2, wherein said second hexagon shaped wedge has an apex and pointed top area; each axis of said hexagon shaped wedge forming three equally spaced extended triangularly shaped wedge arms; each arm's length being equal to the radius length of the circumference of the affixed three support arms means; said triangularly shaped wedge arms having horizontally positioned rings located on their end areas for slidably coacting with said support arm means, said horizontally positioned rings being larger in circumference than the affixed support arms means; and said hexagon shaped wedge having a centrally located extended perpendicular hammering area located on the hexagon shaped wedge's opposite side, whereby a log placed in said first device between said first and second wedge means is split by striking and hammering area with an impacting tool.

* * * * *